US005303859A

United States Patent [19]

Jenkin

[11] Patent Number: 5,303,859

[45] Date of Patent: Apr. 19, 1994

[54] SHOTGUN SLING MOUNTING APPARATUS

[76] Inventor: Timothy J. Jenkin, 2319 Pershing Blvd., Clinton, Iowa 52732

[21] Appl. No.: 50,599

[22] Filed: Apr. 22, 1993

[51] Int. Cl.[5] ..... F41C 33/00

[52] U.S. Cl. ..... 224/149; 224/150; 224/205; 224/913

[58] Field of Search ..... 224/913, 149, 150, 257, 224/201, 205

[56] References Cited

U.S. PATENT DOCUMENTS

| | | | |
|---|---|---|---|
| 2,296,733 | 9/1942 | Paolino | 224/913 X |
| 2,357,363 | 9/1944 | Smith et al. | 224/913 X |
| 2,885,812 | 5/1959 | Arpin | 224/913 X |
| 2,915,233 | 12/1959 | Moomaw | 224/913 X |
| 3,664,558 | 5/1972 | Tolliver | 224/913 X |
| 4,299,343 | 11/1981 | Atchisson | 224/149 |
| 4,555,051 | 11/1985 | Johnson | 224/150 |
| 4,571,872 | 2/1986 | Johnson | 224/150 X |
| 4,691,852 | 9/1987 | Phelps | 224/150 |

*Primary Examiner*—Ernest G. Cusick
*Attorney, Agent, or Firm*—Leon Gilden

[57] ABSTRACT

A first support ring is arranged for positioning about a forward threaded portion of a magazine tube to complementarily engage a bottom surface of the associated gun barrel, wherein a second ring is arranged for locked engagement with the first ring upon directing the associated magazine tube cap into abutting relationship with locking spheres mounted in a projecting relationship relative to the forward walls of the second support ring. A mounting plate is oriented between the butt stock and the butt pad of the associated shotgun, wherein a flexible sling member is arranged for securement between the second support ring having a mounting lug and the mounting plate having a mounting plate mounting lug extending beyond the respective second support ring and the mounting plate.

5 Claims, 3 Drawing Sheets 6
6

10
22
14
23
16
17
13
12
31
33

31
34
38
36
38
34
32
33
37

35
39
38
38
40
40
B
B 38
38
40
41

36
41
38
40
30

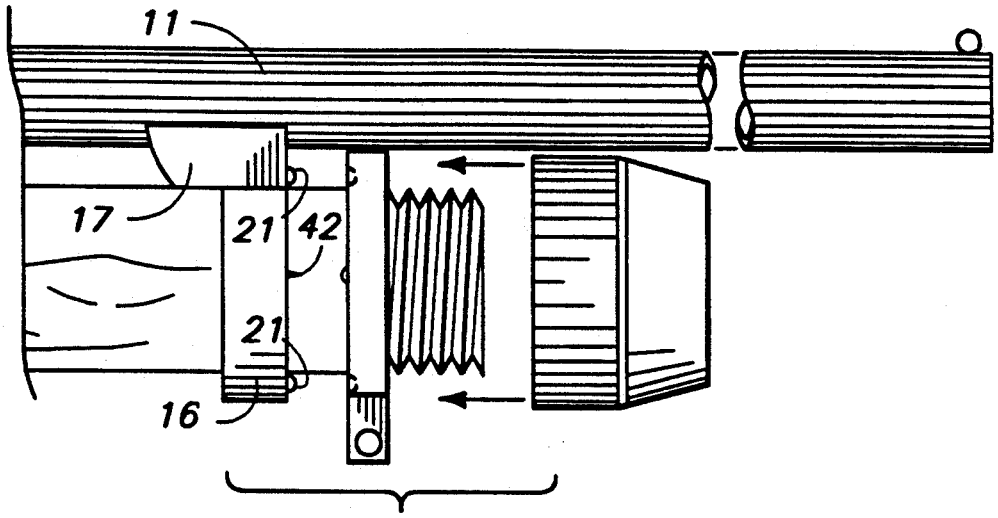
Fig. 16
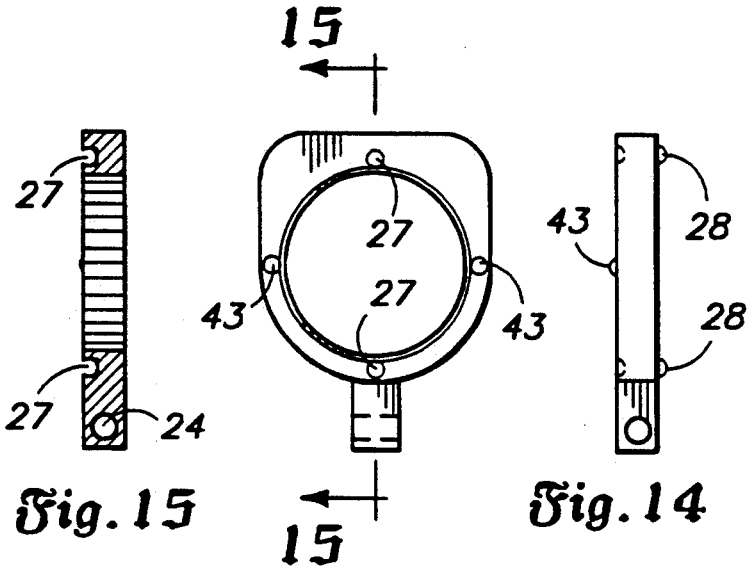
Fig. 15
Fig. 13
Fig. 14
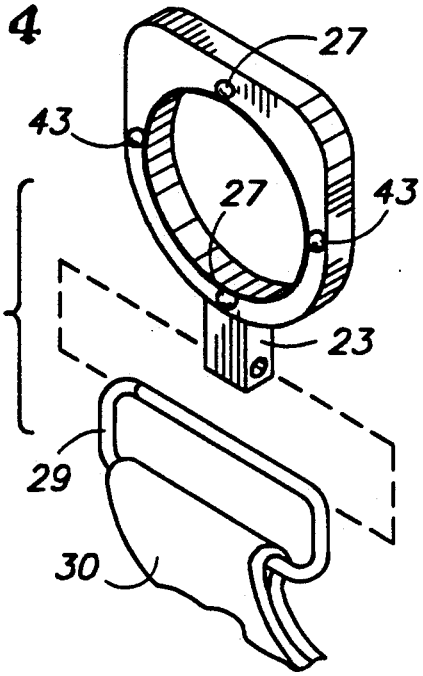
Fig. 12

SHOTGUN SLING MOUNTING APPARATUS

BACKGROUND OF THE INVENTION

1. Field of the Invention

The field of invention relates to sling arrangements for firearms, and more particularly pertains to a new and improved shotgun sling mounting apparatus wherein the same is arranged for the ease of retrofit of a carrying sling to a shotgun assembly without resort to deformation of the shotgun butt stock and magazine tube forearm stock assembly.

2. Description of the Prior Art

Typically, in the mounting of a support sling structure to a shotgun, brazing of a support lug to the shotgun barrel or alternatively the directing of fasteners into the butt stock and forearm stock of the associated shotgun is required to permit support of a sling relative to the shotgun assembly. The instant invention attempts to overcome deficiencies of the prior art by providing a retrofit apparatus arranged for ease of securement to the shotgun magazine tube, as well as the shotgun butt stock and in this respect, the present invention substantially fulfills this need.

SUMMARY OF THE INVENTION

In view of the foregoing disadvantages inherent in the known types of shotgun sling apparatus now present in the prior art, the present invention provides a shotgun sling mounting apparatus wherein the same is arranged for the retrofit of a shotgun sling to a shotgun assembly. As such, the general purpose of the present invention, which will be described subsequently in greater detail, is to provide a new and improved shotgun sling mounting apparatus which has all the advantages of the prior art shotgun sling mounting apparatus and none of the disadvantages.

To attain this, the present invention provides a first support ring arranged for positioning about a forward threaded portion of a magazine tube to complementarily engage a bottom surface of the associated gun barrel, wherein a second ring is arranged for locked engagement with the first ring upon directing the associated magazine tube cap into abutting relationship with locking spheres mounted in a projecting relationship relative to the forward walls of the second support ring. A mounting plate is oriented between the butt stock and the butt pad of the associated shotgun, wherein a flexible sling member is arranged for securement between the second support ring having a mounting lug and the mounting plate having a mounting plate mounting lug extending beyond the respective second support ring and the mounting plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shotgun sling mounting apparatus which has all the advantages of the prior art shotgun sling mounting apparatus and none of the disadvantages.

It is another object of the present invention to provide a new and improved shotgun sling mounting apparatus which may be easily and efficiently manufactured and marketed.

It is a further object of the present invention to provide a new and improved shotgun sling mounting apparatus which is of a durable and reliable construction.

An even further object of the present invention is to provide a new and improved shotgun sling mounting apparatus which is susceptible of a low cost of manufacture with regard to both materials and labor, and which accordingly is then susceptible of low prices of sale to the consuming public, thereby making such shotgun sling mounting apparatus economically available to the buying public.

Still yet another object of the present invention is to provide a new and improved shotgun sling mounting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 12 is an isometric illustration of a modified second support ring of the invention.

FIG. 13 is an orthographic frontal view of the modified second support ring, as indicated in FIG. 12.

FIG. 14 is an orthographic side view of the modified second support ring.

FIG. 15 is an orthographic view, taken along the lines 15—15 of FIG. 13 in the direction indicated by the arrows.

FIG. 16 is an orthographic view indicating the modified second support ring arranged for securement to the first support ring.

DESCRIPTION OF THE PREFERRED EMBODIMENT

Figures 1, 2, 3, 4, 5, 6:
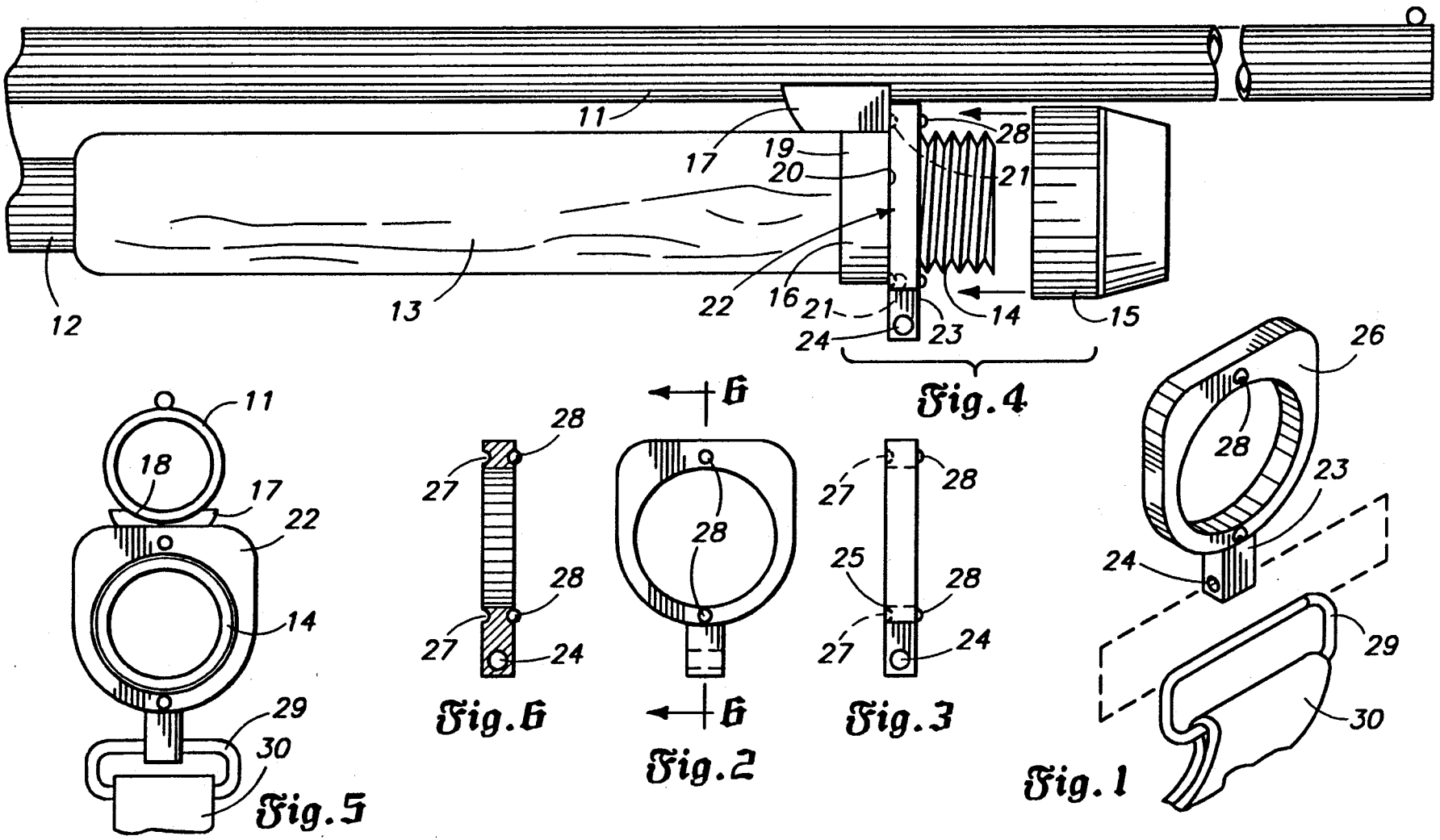
FIG. 1 is an isometric illustration of the second support ring arranged for securement to an associated sling ring member.
FIG. 2 is an orthographic frontal view of the second support ring.
FIG. 3 is an orthographic side view of the second support ring.
FIG. 4 is an isometric illustration of the first and second support rings arranged for securement to the magazine tube forward threaded end portion.
FIG. 5 is an orthographic view of the second support ring structure secured to the magazine tube threaded forward end portion.
FIG. 6 is an orthographic view, taken along the lines 6—6 of FIG. 2 in the direction indicated by the arrows.
Figures 7, 8, 9, 10, 11:
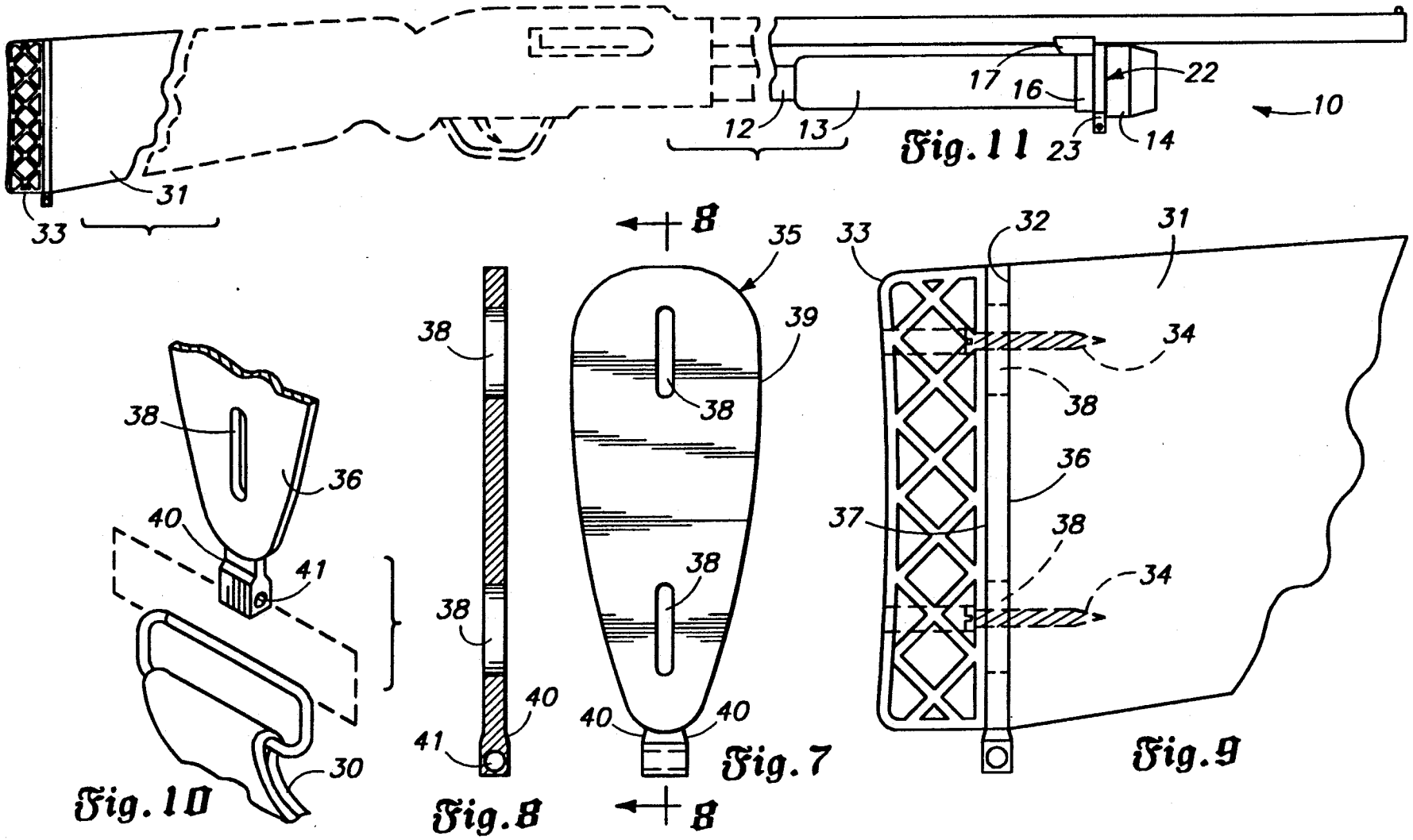
FIG. 7 is an orthographic frontal view of the butt stock mounting plate.
FIG. 8 is an orthographic view, taken along the lines 8—8 of FIG. 7 in the direction indicated by the arrows.
FIG. 9 is an orthographic view indicating the butt stock mounting plate interposed between the butt stock and the recoil pad of the associated shotgun assembly.
FIG. 10 is an isometric illustration of the carrying sling arranged for securement to the mounting plate.
FIG. 11 is an orthographic view indicating the organization in an assembled configuration relative to an associated shotgun.

With reference now to the drawings, and in particular to FIGS. 1 to 16 thereof, a new and improved shotgun sling mounting apparatus embodying the principles and concepts of the present invention and generally designated by the reference numeral 10 will be described.

More specifically, the shotgun sling mounting apparatus 10 of the instant invention essentially comprises cooperation with a shotgun assembly having a shotgun barrel 11, including a shotgun magazine tube 12. A magazine tube stock member 13 receives a magazine tube 12 therethrough, with the magazine tube 12 terminating in a threaded end portion 14 extending beyond the stock member 13. A threaded end portion cap 15 is arranged for securement about the threaded end portion 14. A first support ring 16 is provided received about the threaded end portion 14. The first support ring 16 includes a barrel lug 17 diametrically opposed to the mounting lug 23. The barrel lug 17 includes a concave barrel receiving top wall 18 of complementary reception of the shotgun barrel 11 therewithin, in a manner as illustrated in FIG. 4 and FIG. 5 for example. The first support ring 16 further includes a first support ring rear wall 19 spaced from and parallel a first support ring forward wall 20, with first ring forward wall locking projections 21 extending beyond the first support ring forward wall 20. A second support ring 22 is further provided having said second support ring mounting lug 23, having a mounting lug bore 24 directed therethrough arranged to receive a forward sling member 29 of the associated flexible shotgun sling 30 that extends from the shotgun butt stock 31 to the second support ring mounting lug 23, in a manner as indicated and exemplified by the FIG. 11. The second support ring 22 is formed with a second ring rear wall 25 spaced from and parallel a second ring forward wall 26. Second ring rear wall recesses 27 are arranged, with each arranged to receive one of the first ring forward wall locking projections 21. It should be understood that only one such forward ring locking projection 21 is necessary relative to only one rear wall recess 27 to prevent rotation of the second support ring relative to the first ring, wherein for purposes of illustration, a second first ring forward wall locking projection 21 arranged to cooperate with a second ring rear wall recess 27 is illustrated. A plurality of second ring front wall projections 28 are arranged to extend beyond the second ring front wall 26 to frictionally engage the cap 15. In this manner, the projections 28 may, if desired, be formed of a resilient material to enhance frictional inter-engagement of the cap and the second support ring wherein alternatively, rigid locking spheres may be provided to engage the cap thusly also permitting locking inter-engagement of the cap and securement of the first and second support rings relative to the shotgun assembly, in a manner as illustrated in the FIG. 11.

A shotgun butt stock 31 of conventional configuration includes a butt stock rear wall 32 arranged to accommodate a shotgun rear wall pad 33 to provide a fastener arranged for projection through the pad 33 into the shotgun butt stock 31 through the butt stock rear wall 32. The invention is arranged to provide a mounting plate 35 having a mounting plate front wall 36 spaced from a mounting plate rear wall 37, including mounting place slots 38 extending through the front wall and rear wall arranged to receive the fasteners therethrough when positioning the mounting plate 37 intermediate the butt stock rear wall 32 and the rear wall pad 33. In this manner, the sling may be attached to the mounting plate downwardly extending lug 40 mounted integrally to the mounting plate periphery 39, with a mounting plate lug bore 41 arranged to receive a rearwardmost sling ring member for securement and attachment to the associated flexible sling 30.

The FIGS. 12–16 indicates the use of a modified second support ring, having in addition to the second ring rear wall recesses 27, a plurality of fluid adhesive filled capsules 43 mounted to the second support ring rear wall concentric with the recesses 27 such that the first support ring includes an individual puncture pin 42 arranged in a coaxially aligned relationship to each of the capsules 43, as indicated in FIG. 16, to effect rupture of the capsules such that upon securement of the first support ring relative to the second support ring, the capsules are ruptured releasing the fluid adhesive therewithin permitting a permanent securement of the first support relative to the second support ring in use. It should be understood that the adhesive capsules may be eliminated, whereupon the organization is to function in a manner as described above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shotgun sling mounting apparatus arranged for securement to an associated shotgun assembly, wherein the shotgun assembly includes a shotgun barrel, having a magazine tube extending in adjacency to the barrel, with the magazine tube including a stock member and a threaded end portion extending from the magazine tube beyond the stock member, with the shotgun assembly further having a shotgun butt stock, having a butt stock rear wall, wherein the apparatus comprises, a first support ring, the first support ring having a first support ring central opening arranged for receiving the magazine tube threaded end portion therethrough, the first support ring including a first support ring lug, the first support ring lug having a concave barrel receiving top wall arranged to complementarily receive the shotgun barrel, with the first support ring having a first support ring front wall spaced from a first support ring rear wall, the first support ring front wall having at least one locking projection extending therefrom, and a second support ring, the second support ring having a second support ring rear wall and a second support ring front wall, said second support ring rear wall arranged to receive said at least one locking projection, with a second support ring central opening arranged in a coaxially aligned relationship relative to the first support ring central opening receiving the magazine tube threaded end portion therethrough, and the second support ring rear wall arranged for engaging the first support ring front wall locking projection, the second support ring having a second support ring lug, with a second support ring lug opening arranged to accommodate a sling ring member, and a mounting plate, the mounting plate having a mounting plate front wall and a mounting plate rear wall, the mounting plate front wall arranged for abutting engagement with the butt stock rear wall, and the mounting plate including at least one mounting plate slot arranged to receive a fastener through the at least one slot into the butt stock, with the mounting plate having a mounting plate periphery, the mounting plate periphery including a mounting plate lug, the mounting plate lug including a mounting plate lug bore arranged to receive a further sling ring member.

2. An apparatus as set forth in claim 1 wherein the second support ring mounting lug and the first support ring barrel lug are arranged in a diametrically opposed orientation relative to one another.

3. An apparatus as set forth in claim 2 wherein the second support ring rear wall includes a second support ring rear wall recess aligned with said at least one first support ring forward wall locking projection.

4. An apparatus as set forth in claim 3 wherein the apparatus includes a locking cap, the second support ring forward wall includes at least one second support ring forward wall projection arranged to engage said locking cap, that in turn is arranged for threaded securement to the magazine tube threaded end portion.

5. An apparatus as set forth in claim 4 wherein the second support ring rear wall includes at least one fluid filled capsule arranged in adjacency to said second support ring central opening spaced from said at least one second ring rear wall recess, and the first support ring having a puncture pin mounted thereto in aligned relationship relative to said at least one capsule to effect rupturing of said capsule upon engagement of said first support ring with said second support ring.

* * * * *